US011419417B1

(12) United States Patent
Odum

(10) Patent No.: US 11,419,417 B1
(45) Date of Patent: Aug. 23, 2022

(54) BARBER CHAIR WITH INTEGRATED CHILD SEAT

(71) Applicant: Myles Odum, Falls Church, VA (US)

(72) Inventor: Myles Odum, Falls Church, VA (US)

( * ) Notice: Subject to any disclaimer, the term of this patent is extended or adjusted under 35 U.S.C. 154(b) by 0 days.

(21) Appl. No.: 17/165,128

(22) Filed: Feb. 2, 2021

(51) Int. Cl.
*A47C 1/11* (2006.01)
*A47D 11/02* (2006.01)

(52) U.S. Cl.
CPC ..... *A47C 1/11* (2013.01); *A47D 11/02* (2013.01)

(58) Field of Classification Search
CPC ..... A47C 1/11; A47C 1/08; B60N 2/3084
See application file for complete search history.

(56) References Cited

U.S. PATENT DOCUMENTS 1,370,986 A * 3/1921 Mudd ..... A47C 1/11 297/114
1,599,425 A * 9/1926 McGuire ..... C22C 38/50 420/4
1,805,189 A * 5/1931 Rothe ..... A47C 1/11 297/238
1,948,786 A * 2/1934 Dorrell ..... A47C 3/30 297/338
4,936,627 A 6/1990 Guim
4,943,112 A 7/1990 Law
5,205,608 A * 4/1993 Stig ..... B60N 2/3084 108/44
5,224,756 A * 7/1993 Dukatz ..... B60N 2/3084 297/114
5,429,414 A * 7/1995 Olsson ..... B60N 2/3084 297/14
5,474,357 A 12/1995 Dukatz et al.
5,527,093 A 6/1996 Park
7,871,124 B1 1/2011 Hinds
10,766,386 B1 * 9/2020 West ..... B60N 2/265

* cited by examiner

*Primary Examiner* — Sarah B McPartlin
(74) *Attorney, Agent, or Firm* — Boudwin Intellectual Property; Daniel Boudwin

(57) ABSTRACT

A barber chair with an integrated child seat. The present invention includes a chair having a main seat and a back rest with a cavity formed within the front facing side of the back rest. A child seat is shaped to fit the cavity in the back rest and is pivotally attached to the main seat, allowing the child seat to be rotated. In one embodiment, the child seat has a top member and a bottom member. When the child seat is rotated downward toward the main seat, the top member can be rotated into an upright position where it lies flush with the upper part of the back rest, creating a complete back rest with no substantial gaps. In some embodiments, the child seat includes a single member. In some embodiments, the barber chair is equipped with a mechanism to easily release the child seat from its stored position.

9 Claims, 9 Drawing Sheets

BARBER CHAIR WITH INTEGRATED CHILD SEAT

BACKGROUND OF THE INVENTION

The present invention relates to barber chairs. More specifically, the present invention relates to barber chairs having a built in child seat with a back rest configured to be positioned flush with the main chair.

Barber chairs are primarily designed to provide a comfortable and convenient place for persons to sit while having their hair cut and styled. While many barber chairs are configured to be adjustable to serve the needs of various sized clients, most are solely designed with adults in mind. This often results in a chair that can only be raised to a height off the floor which is appropriate for an adult of average size. Even if a chair can be raised sufficiently, the back of the barber chair can be tall and interfere with the haircut of a child.

Attempting to use such a chair to give a haircut to a child can result in a clumsy and cumbersome experience. In order to accommodate the shorter stature of children, barbers and hairdressers will frequently use a booster seat. While there are currently available booster seats that are designed to be used with a barber chair, these are often no more than a leather covered box. The disadvantages of using such a booster seat include the unsecure nature of a simple box sitting on a chair while a child is seated thereon. Additionally, these can be quite cumbersome to handle and require storage space that is large enough to accommodate its size while still being easily accessible for use whenever a child customer enters a barbershop or hair salon.

SUMMARY OF THE INVENTION

In view of the foregoing disadvantages inherent in the known types of barber chairs now present in the prior art, the present invention provides a barber chair with an integrated child seat wherein the same can be utilized for providing convenience for the user when cutting and styling the hair of a child.

The present invention comprises a chair having a main seat and a back rest, with a cavity formed within a front facing side of the back rest. A child seat is pivotally attached to the main seat and shaped to fit within the cavity in the back rest, allowing the child seat to be stored in an upright position, where it is configured to be a partial back rest and lie flush with the back rest. The child seat has a top member and a bottom member. When the child seat is rotated downward to be parallel with the main seat, the top member can be rotated back into an upright position where it is designed to lie flush with the upper part of the back rest, creating a complete back rest with no substantial gaps. This flush fit not only provides a comfortable back rest, but prevents hair from collecting inside the cavity. In some embodiments, the child seat comprises a single member. Additionally, the seat can be equipped with a mechanism to easily release the child seat.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
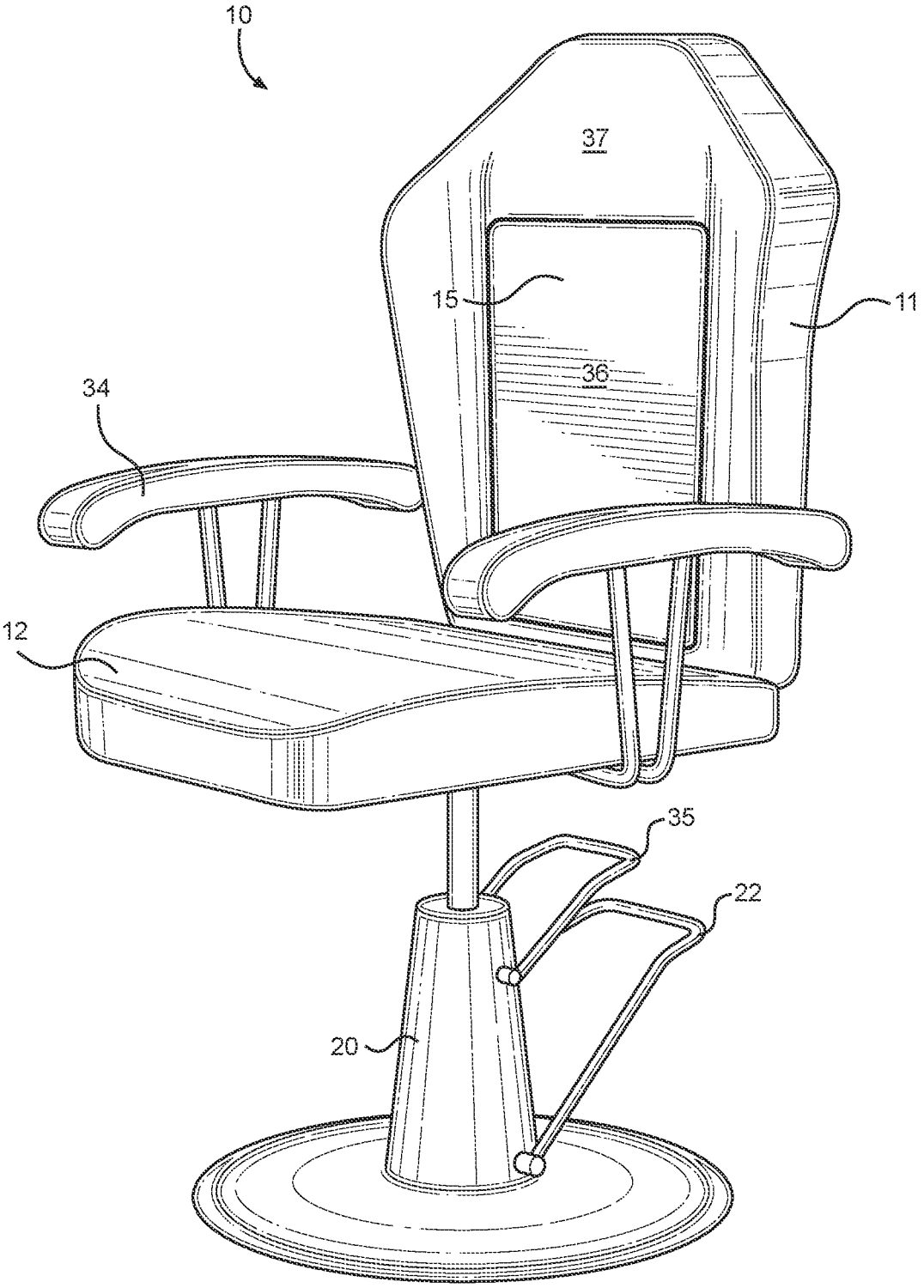
FIG. 1A shows a perspective view of an embodiment of the barber chair with the integrated child seat stored in the back rest.

Reference is made herein to the attached drawings. Like reference numerals are used throughout the drawings to depict like or similar elements of the barber chair with integrated child seat. The figures are intended for representative purposes only and should not be considered to be limiting in any respect.

Figure 1B:
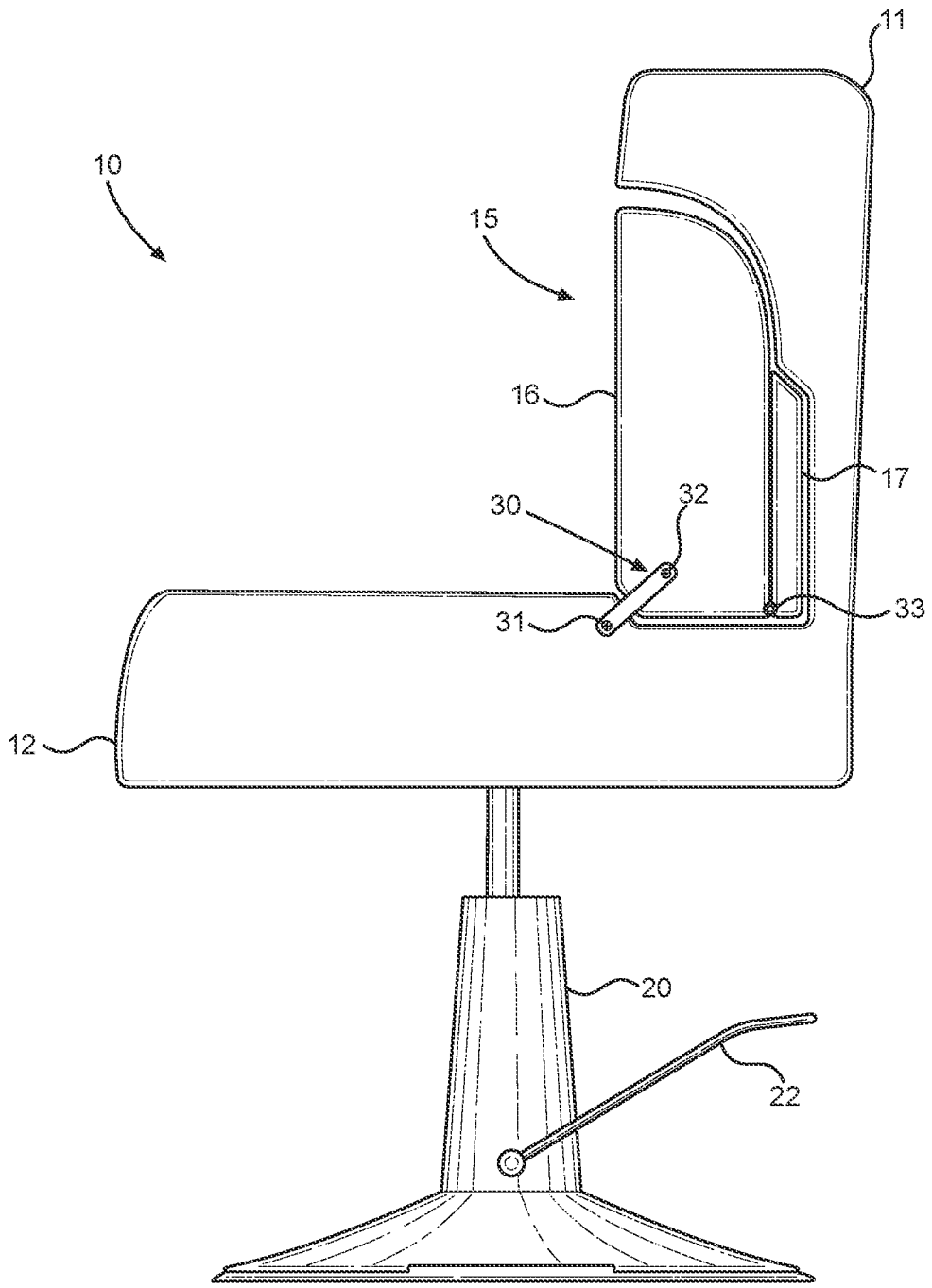
FIG. 1B shows a cross sectional view of an embodiment of the barber chair with the integrated child seat stored in the back rest.

Referring now to FIGS. 1A and 1B, there is shown a perspective view and a cross sectional view of an embodiment of the barber chair with the integrated child seat stored in the back rest. The barber chair 10 comprises a main seat 12, a back rest 11, and an integrated child seat 15. The back rest 11 has a cavity shaped to fit the child seat 15 when the integrated child seat 15 is stored in a vertical position. In one embodiment, the main seat 12 and the back rest 11 have a unitary construction. In an alternative embodiment, the main seat 12 and back rest 11 are constructed of separate pieces, and pivotally connected with a hinge, where the hinge in configured to allow the back rest 11 to be reclined away from the main seat 12 and locked in various positions. In the illustrated embodiment, the cavity comprises a same dimension as the integrated child seat 15, such that an outer surface of the integrated child seat 15 aligns flush with the outer surface of the back rest 11 when stored in the vertical position. The barber chair 10 further comprises a pair of armrests 34 disposed along the lateral sides thereof and configured to support the arms of a user when seated upon the main seat 12.

In the illustrated embodiment shown in FIG. 11, the integrated child seat 15 comprises a top member 17 and a bottom member 16, wherein the bottom member 16 is pivotally connected to the main seat 12. In one embodiment, this first pivot connection is a hinge 30 having a first connection point 31 on the base of the seat and a second connection point 32 on the bottom member 16 of the child seat 15. In an alternative embodiment, the first pivot connection can be a continuous hinge, such as a piano hinge or a live hinge. Additionally, the top member 17 of the integrated child seat 17 is pivotally connected to the bottom member 16 of the integrated child seat 15. In one embodiment of the barber chair 10, this second pivot connection is a continuous hinge 33, such as a piano hinge or a live hinge. In another embodiment of the invention this second pivot connection is a hinge placed on the sides of the integrated child seat 15.

In the illustrated embodiment, the main seat 12 is disposed on top of a pedestal support 20. In one embodiment of the barber chair 10 the pedestal support 20 is fixed. In an alternative embodiment of the barber chair 10 the pedestal support 20 is adjustable in height such that it is configured to be raised and lowered. This can be accomplished with a mechanical gear, such as a rack and pinion gear, or with a hydraulic system, such as a hydraulic piston. Either configuration can be controlled with a lever 22 mounted onto the pedestal support 20.

Figure 2:
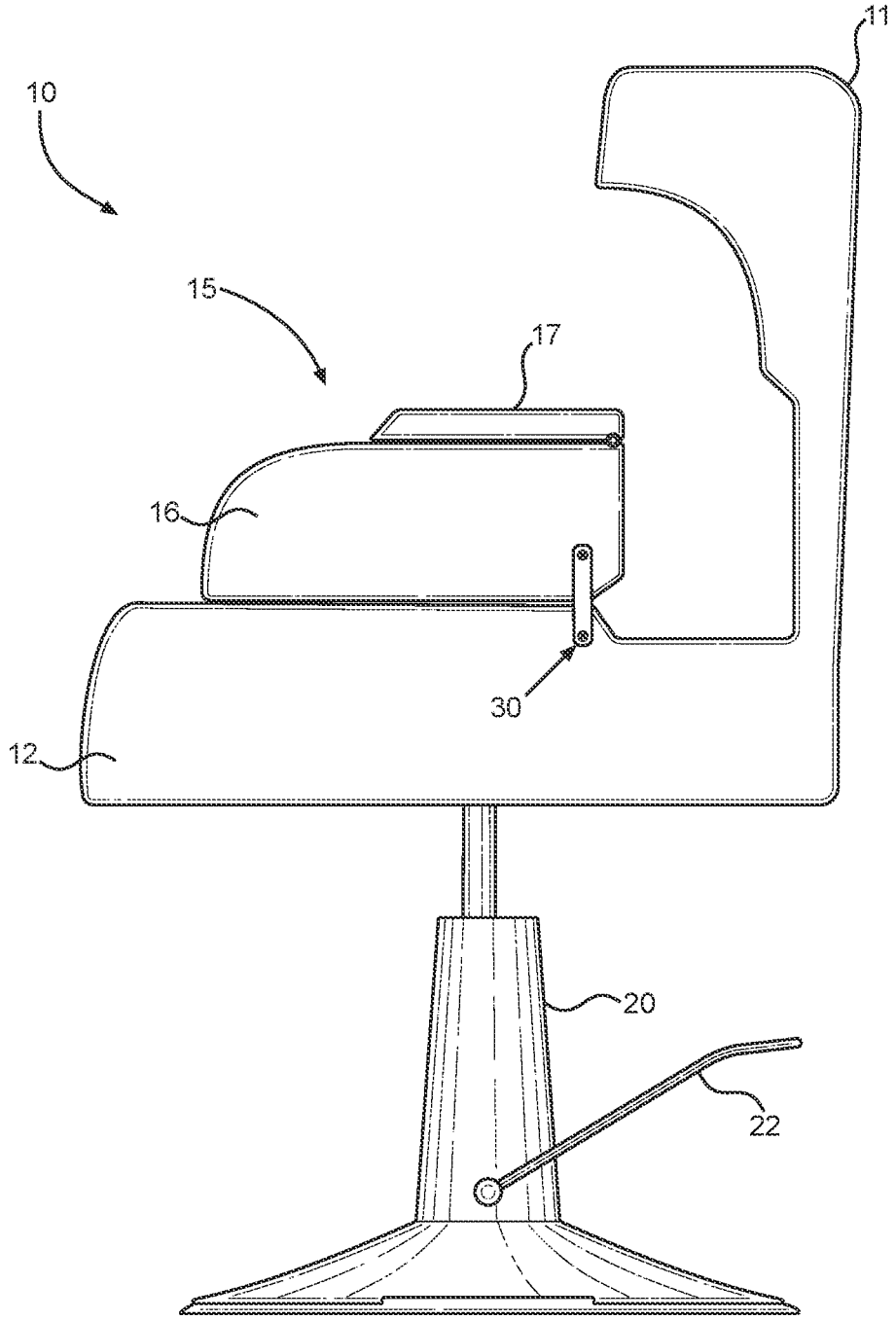
FIG. 2 shows a cross sectional view of an embodiment of the barber chair with the integrated child seat in a lowered position.
Figure 3:
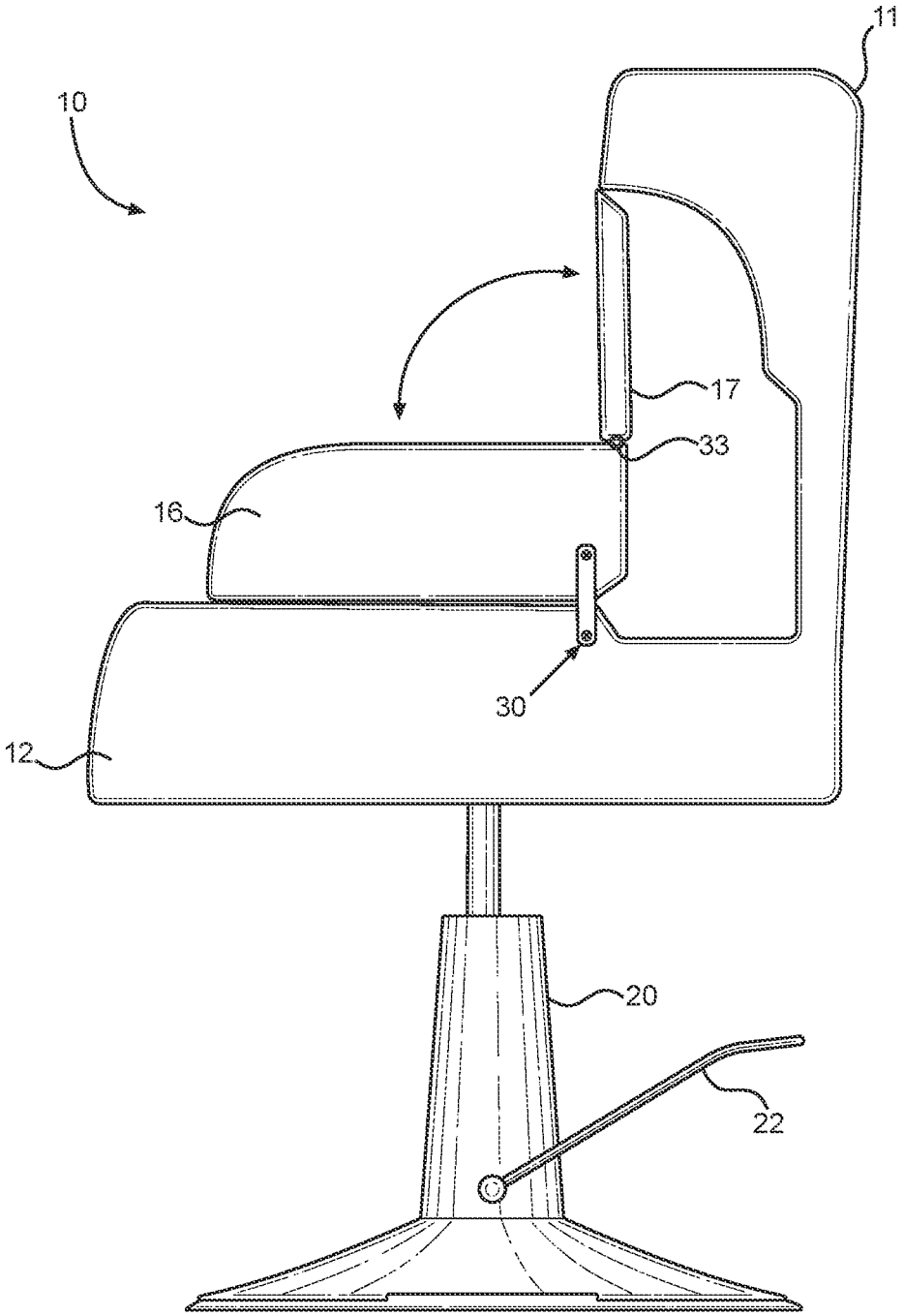
FIG. 3 shows a cross sectional view of an embodiment of the barber chair with the integrated child seat in a lowered position and the top member in an open position.

Referring now to FIGS. 2 and 3, there are shown a cross sectional views of an embodiment of the barber chair with the integrated child seat in a lowered position. In use, the integrated child seat 15 is lowered from a vertical stored position to a deployed horizontal position. Once the bottom member 16 of the integrated child seat 15 is in a horizontal position resting on top of the main seat 12, the top member 17 can be rotated back to a vertical position, as shown in FIG. 3. This is the deployed position. A child can then be seated on the bottom member 16 and a barber or hairdresser can easily perform various haircutting tasks.

The dimension of the cavity in the back rest 11 is configured such that when the top member 17 is in an upright position, there is a close tolerance fit where there are no substantial gaps between the top member 17 and the back rest 11. This allows for a continuous secondary back rest for the child seat, comprised of both the top member 17 and an upper portion of the back rest 11. Additionally, this close tolerance fit prevents cut hair entering the cavity.

Figure 4:
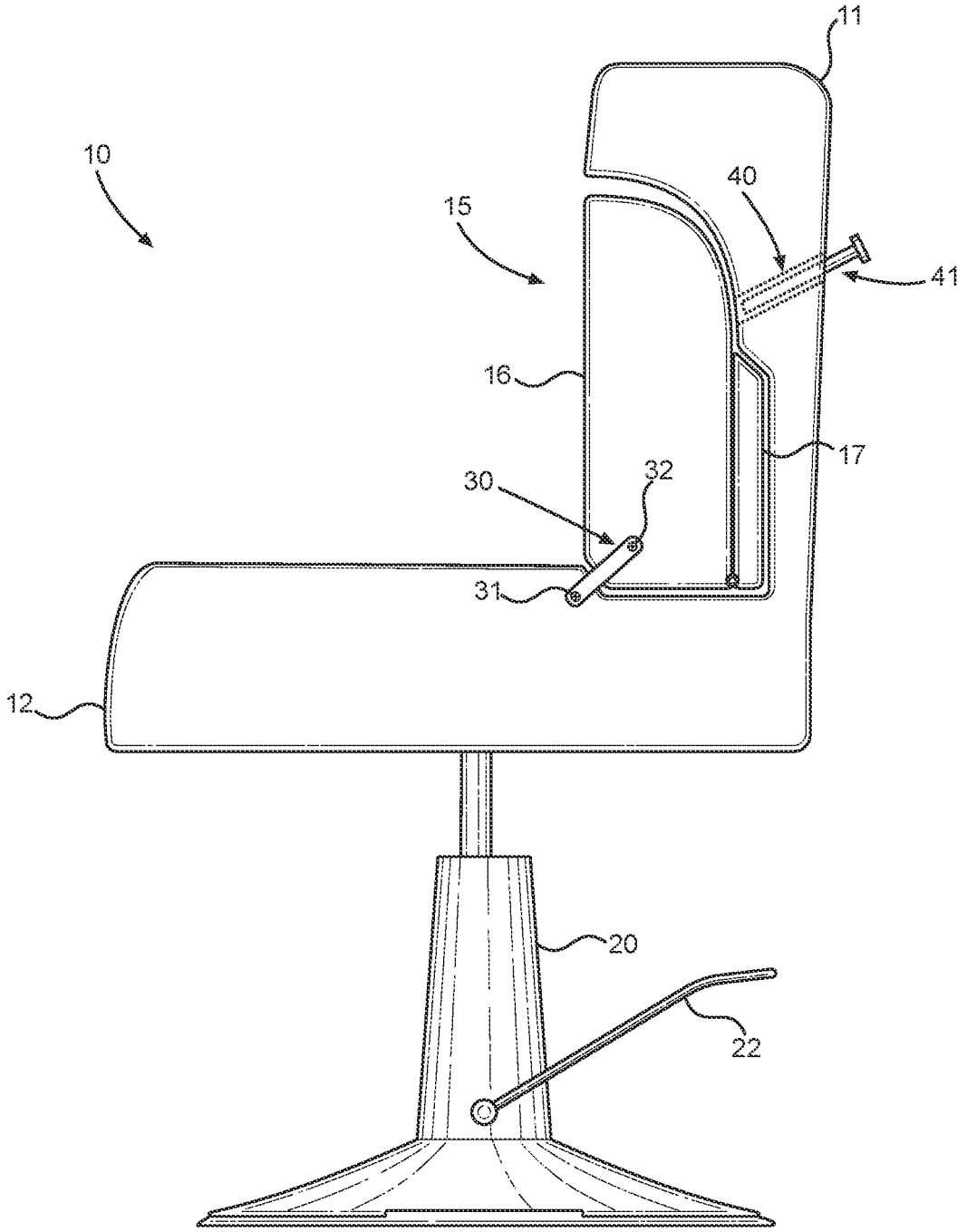
FIG. 4 shows a cross sectional view of a first additional embodiment of the barber chair with a mechanism to release the child seat.

Referring now to FIG. 4, there is shown a cross sectional view of a first additional embodiment of the barber chair with a release mechanism to release the child seat. Some embodiments of the barber chair with integrated child seat include a release lever operably connected to the integrated child seat such that when the release lever is actuated, the integrated child seat moves from the stored position to the deployed position. In the illustrated embodiment, the release lever is a release mechanism having a channel 40 with a first end and a second end, the channel extending through back rest 11. The first end is disposed on a rear wall of the back rest 11 and the second end is disposed on the interior wall of the back rest 11, adjacent to the cavity and the child seat 15, when the child seat 15 is in a stored vertical position. The channel is configured to admit a plunger 41 with a close tolerance fit. The plunger 41 extends outward from the first end of the channel 40. When the plunger 41 is directed toward the second end of the channel 40, it engages with the integrated child seat 15, releasing the integrated child seat 15 from the cavity and rotating it from an upright stored position toward a horizontal seating position.

In some embodiments, the release mechanism is a tab extending from the outer surface of the integrated child seat 15, wherein the tab is adapted to be manually pulled by the user to pivot the integrated child seat 15 toward the main seat 12.

Figure 5A:
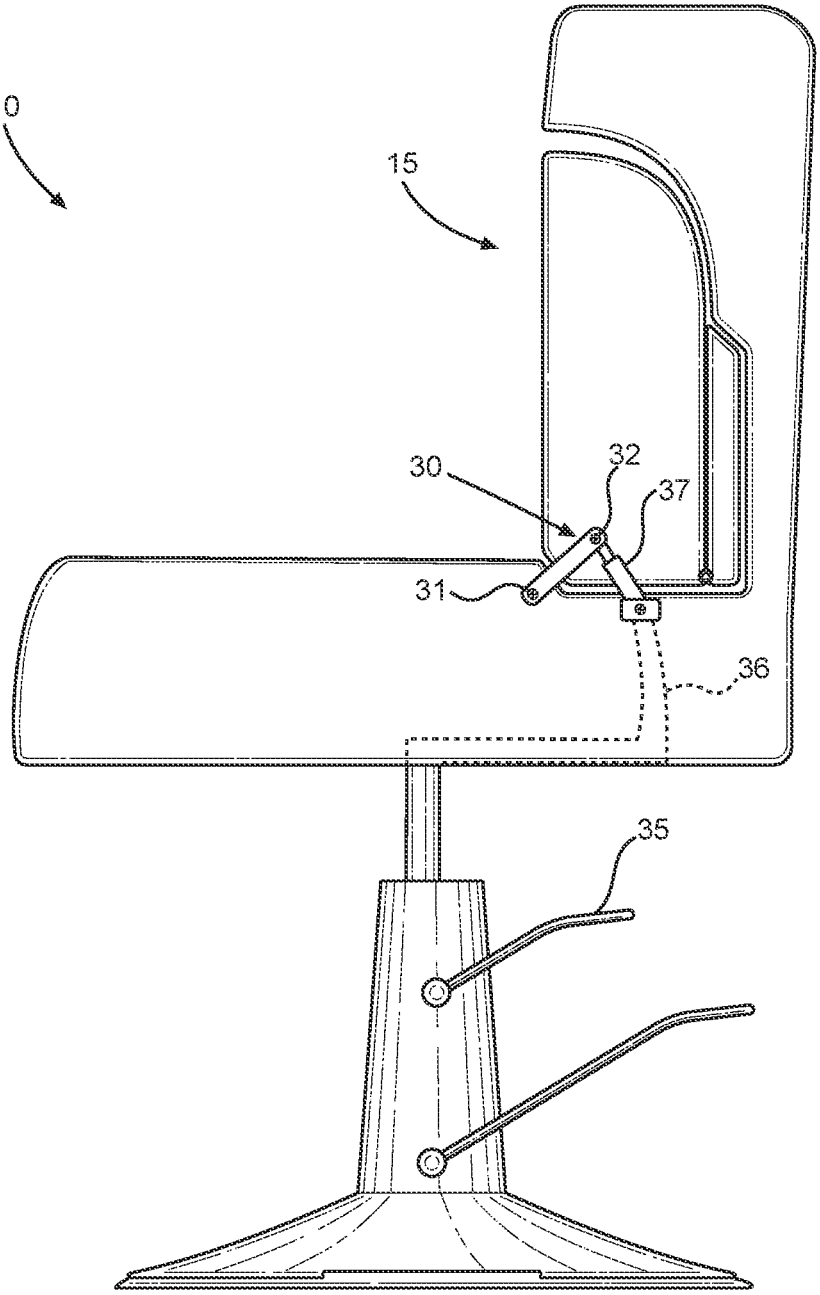
FIG. 5A shows a cross sectional view of a second additional embodiment of the barber chair with a pedal release mechanism to release the child seat.
Figure 5B:
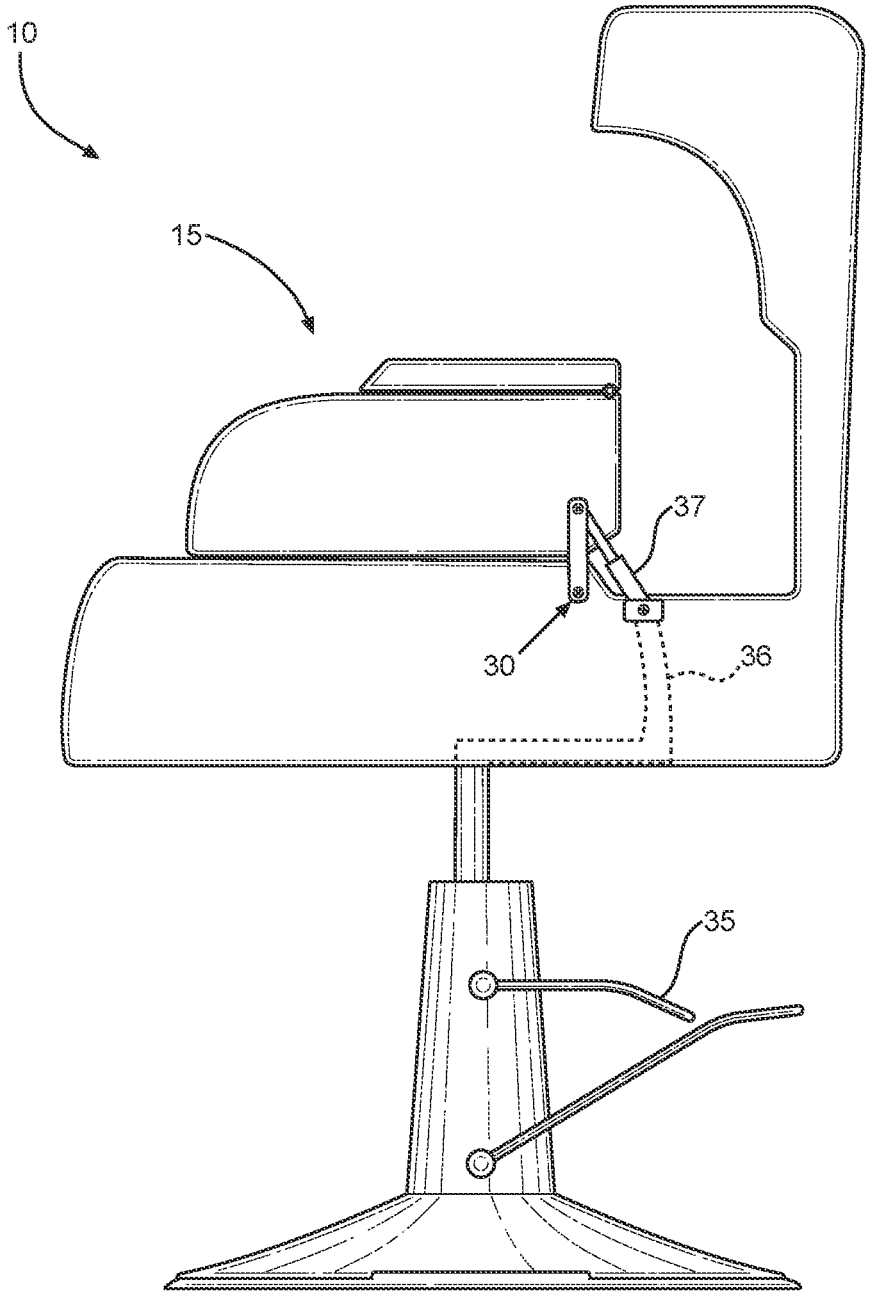
FIG. 5B shows a cross sectional view of a second additional embodiment of the barber chair with a pedal release mechanism to release the child seat in the actuated position.

Referring now to FIGS. 5A and 5B, there are shown cross sectional views of a second additional embodiment of the barber chair with a pedal release mechanism to release the child seat. In the illustrated embodiment, a pedal release mechanism is configured to release the child seat 15. The pedal release mechanism comprises an actuator 35 operably connected to an arm 37 connected to the second connection point 32 of the hinge 30. As the actuator is pressed, the arm 37 is moved via the operable connection 36 and pivots the hinge 30 such that the seat is moved and released from the cavity. In the illustrated embodiment, the operable connection 36 is a hydraulic system that is integrated into the seat. In alternate embodiment, any operable connection is suitable that is configured to release the child seat 15 from the cavity upon actuation of an actuator.

Figure 6:
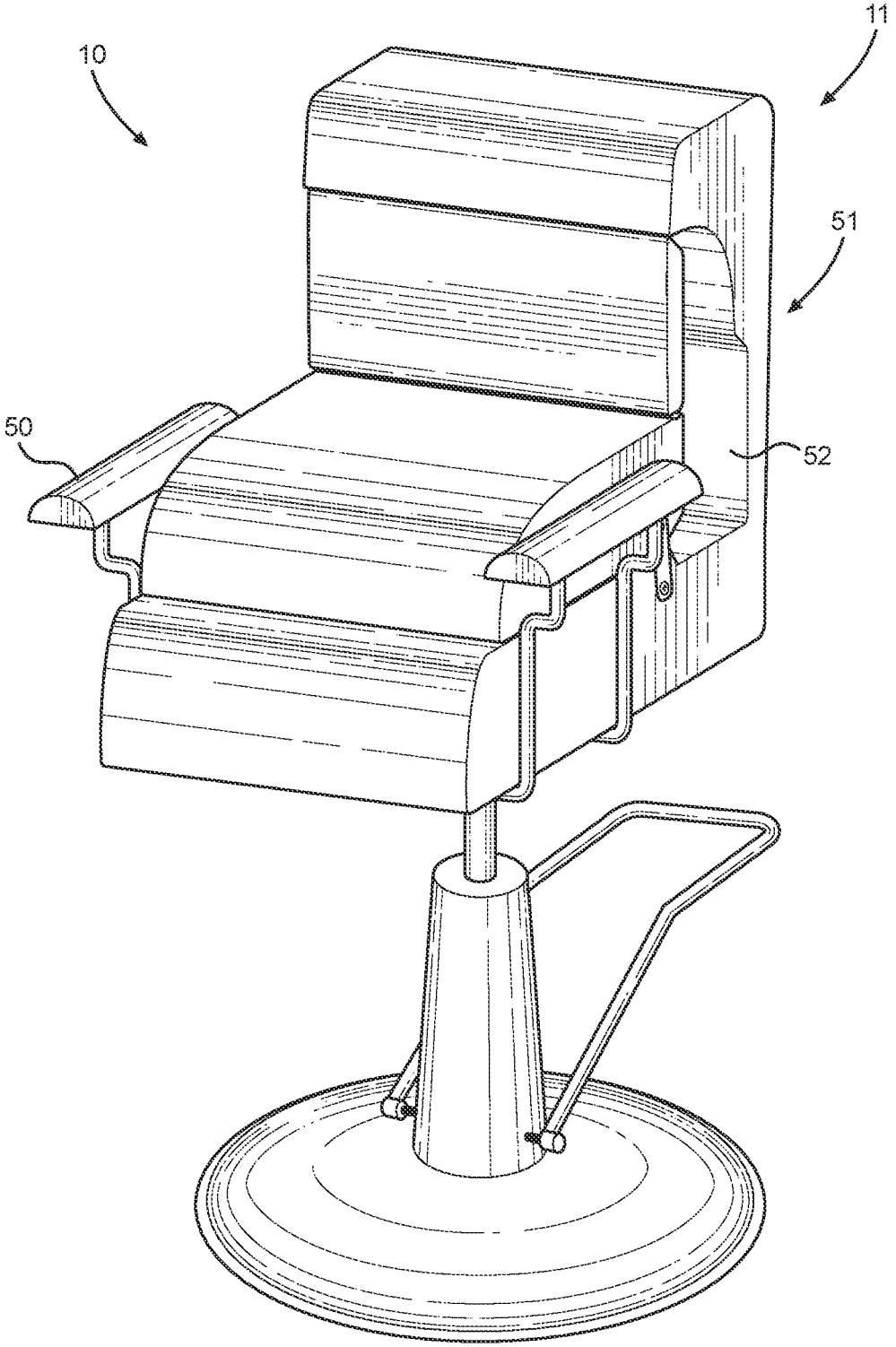
FIG. 6 shows a perspective view of a third additional embodiment of the barber chair.

Referring now to FIG. 6, there is shown a perspective view of a third additional embodiment of the barber chair. In the shown embodiment of the barber chair 10, the back rest 11 is configured with open sides 51, revealing the cavity 52 therein. In other embodiments, the sides of the back rest 11 are closed and the cavity 52 is fully enclosed. In such a configuration, the cavity 52 is fully covered when the integrated child sear 15 is in the deployed position, providing a continuous back for the child and preventing cut hair from entering the cavity 52. The chair can additionally comprise a pair of armrests 50 for a user to rest their arms thereon.

Figure 7:
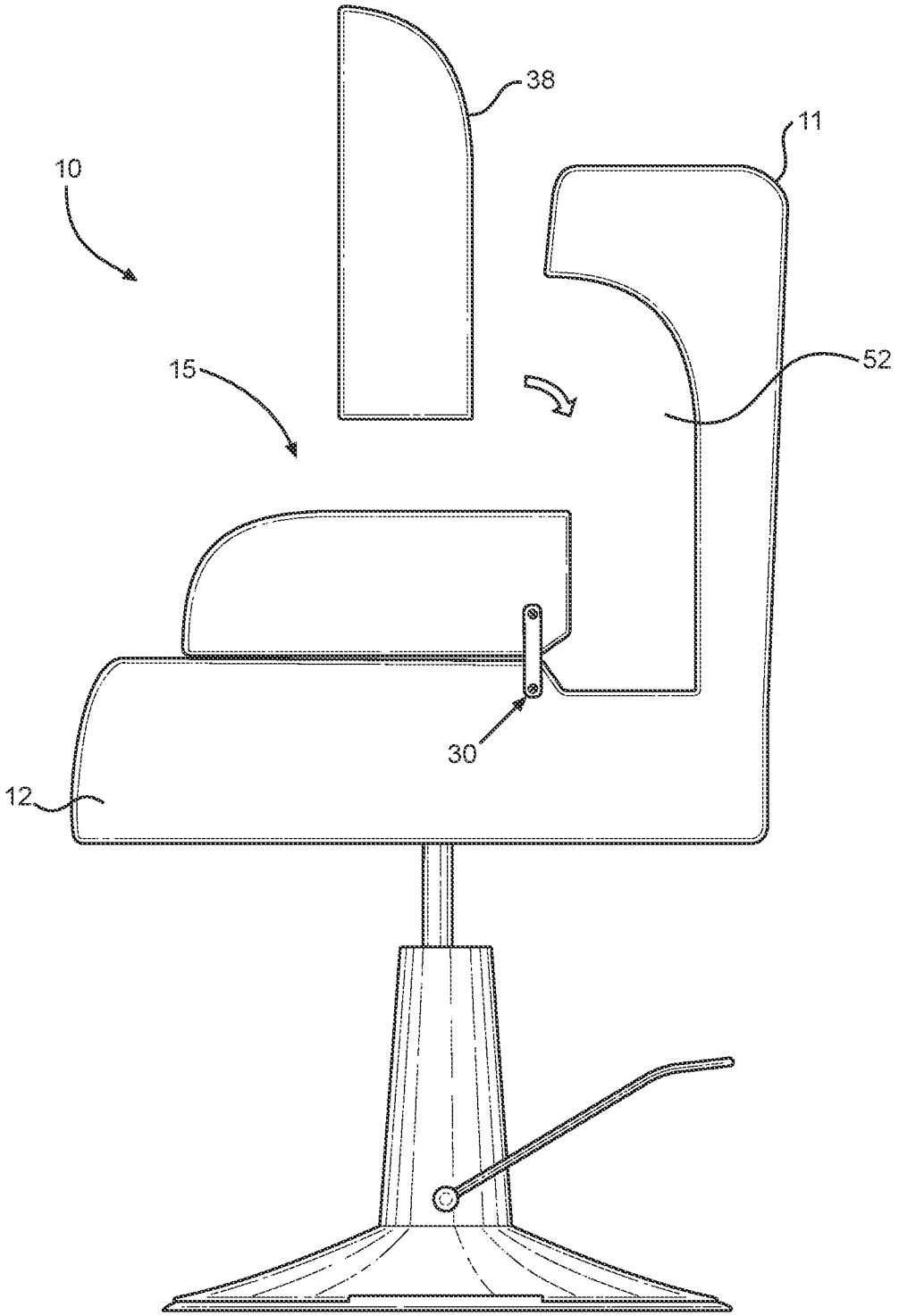
FIG. 7 shows a cross sectional view of a fourth additional embodiment of the barber chair.

Referring now to FIG. 7, there is shown a fourth additional embodiment of the barber chair. In the illustrated embodiment, the integrated child seat 15 comprises a monolithic construction, wherein the integrated child seat does not include a top member pivotally attached thereto. Instead, a removable insert 38 is configured to fit flush within the cavity 52 when the integrated child seat 15 is in a lowered position. Further, the back rest 11 of the barber chair 10 includes a cavity having a same dimension as the removable insert 38. The removable insert 38 is configured to provide a back support when a user is seated on the main seat 12.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A barber chair with integrated child seat, comprising:

a main seat;

a back rest secured to the main seat, the back rest having an interior wall, a rear wall, a front surface and a cavity therein;

an integrated child seat pivotally connected to the main seat, the integrated child seat comprising a top member and a bottom member, the bottom member pivotally connected to the top member, wherein the child seat is configured to fit within the cavity to a close tolerance when rotated to a vertical position with respect to the main seat, such that the integrated child seat is lies flush with the front surface of the back rest;

a pedestal support mounted to the main seat;

a release mechanism adapted to deploy the child seat, wherein the release mechanism comprises a channel disposed on the back rest extending from the rear wall of the back rest to the interior wall of the back rest;

a plunger configured to have a close tolerance fit within the channel and positioned such that when the plunger is moved toward the interior wall of the back rest, the plunger engages the child seat, releasing it from an upright position and directing it to rotate into a horizontal position.

2. The barber chair with integrated child seat of claim 1, further comprising a lever disposed on the pedestal support, the lever configured to raise and lower the main seat.

3. The barber chair with integrated child seat of claim 1, further comprising armrests disposed on two sides of the main seat.

4. The barber chair with integrated child seat of claim 1, wherein the child seat is configured such that when the bottom member is placed parallel to the main seat and the top member is rotated substantially perpendicular to the main seat, the cavity is substantially sealed and the back rest and top member form a secondary back rest.

5. The barber chair with integrated child seat of claim 1, further comprising a release lever operably connected to the integrated child seat such that when the release lever is actuated, the integrated child seat moves from a stored position to a deployed position.

6. The barber chair with integrated child seat of claim 1, further comprising a pedal release mechanism having an actuator operably connected to an arm that moves the child seat when the actuator is engaged.

7. The barber chair with integrated child seat of claim 1, wherein the actuator is positioned on the pedestal support and operably connected to a hydraulic system integrated into the main seat.

8. The barber chair with integrated child seat of claim 1, wherein the arm is connected to a hinge that is directly attached to both the main seat and the bottom member of the child seat, such that when the actuator is engaged the arm rotates the hinge parallel to the backrest.

9. A barber chair with integrated child seat, comprising:

a main seat;

a back rest secured to the main seat, the back rest having an interior wall, a rear wall, a front surface and a cavity therein;

an integrated child seat pivotally connected to the main seat, the integrated child seat comprising a top member and a bottom member, the bottom member pivotally connected to the too member, wherein the child seat is configured to fit within the cavity to a close tolerance when rotated to a vertical position with respect to the main seat, such that the integrated child seat is lies flush with the front surface of the back rest;

a removable insert having a same dimension as the cavity and configured to fit within the cavity when the integrated child seat is in a horizontal position with respect to the main seat;

a pedestal support mounted to the main seat;

a release mechanism adapted to deploy the child seat, wherein the release mechanism comprises a channel disposed on the back rest extending from the rear wall of the back rest to the interior wall of the back rest;

a plunger configured to have a close tolerance fit within the channel and positioned such that when the plunger is moved toward the interior wall of the back rest, the plunger engages the child seat, releasing it from an upright position and directing it to rotate into a horizontal position.

* * * * *